US006155803A

United States Patent [19]

Curington et al.

[11] Patent Number: 6,155,803

[45] Date of Patent: Dec. 5, 2000

[54] RODLESS PUMPING SYSTEM

[75] Inventors: Alfred Ronald Curington, The Woodlands; Floyd John Bradford, Jr., Houston, both of Tex.

[73] Assignee: Downhole Technologies Co., L.L.C., Houston, Tex.

[21] Appl. No.: 09/288,190

[22] Filed: Apr. 8, 1999

[51] Int. Cl.[7] ..... F04B 33/02

[52] U.S. Cl. ..... 417/383

[58] Field of Search ..... 417/383, 384, 417/392, 401, 555.2

[56] References Cited

U.S. PATENT DOCUMENTS

| | | | |
|---|---|---|---|
| 1,946,723 | 2/1934 | Thompson | 417/378 |
| 2,180,366 | 11/1939 | Reichert | 417/378 |
| 2,384,173 | 9/1945 | Johnston | 417/377 |
| 2,562,584 | 7/1951 | Soberg | 417/378 |
| 4,013,385 | 3/1977 | Peterson | 417/377 |
| 4,297,087 | 10/1981 | Akkerman | 417/378 |
| 4,297,088 | 10/1981 | Akkerman | 417/378 |
| 4,540,348 | 9/1985 | Soderberg | 417/383 |
| 4,720,247 | 1/1988 | Strickland et al. | 417/392 |

FOREIGN PATENT DOCUMENTS 2 105 793 3/1983 United Kingdom .

*Primary Examiner*—Teresa Walberg
*Assistant Examiner*—Vinod D Patel
*Attorney, Agent, or Firm*—The Matthews Firm

[57] ABSTRACT

A rodless pump is disclosed which is connected to a pressure source via a conduit. In a common oilfield application the pump would be connected to the bottom of a tubing string within the reservoir fluid to be produced. A pressure source such as a hydraulic pump would be connected at the surface to the tubing string so as to selectively apply pressure via fluid in the conduit to the pump, raising the plunger assembly in the pump drawing reservoir fluid into the pump. When pressure via the surface pressure source is released, a gas source in the pump urges the plunger assembly downward in the pump urging the reservoir fluid in the pump into the tubing and to the surface. Preferably, the pump includes dampening mechanisms at both the top and bottom of the plungers stroke so as to reduce metal to metal impact within the pump. This dampening mechanism may include but is not limited to elastomer barriers, springs, and other dampening mechanisms such as discussed further below.

74 Claims, 7 Drawing Sheets

RODLESS PUMPING SYSTEM

TECHNICAL FIELD

The present invention relates generally to subsurface pumps for removing fluids from underground reservoirs and in particular to a rodless pumping system.

BACKGROUND

Presently, low pressure reservoirs, incapable of producing fluid from the reservoir to the surface naturally, account for over 90% of the hydrocarbon producing wells in the United States. There are various means of pumping fluid from these wells, such as the use of sucker rod pumps, hydraulic pumps, jet pumps, and semi-submersible electric pumps. Most of these low pressure wells produce fluid at too low of a flow rate for the majority of the current art pumps to operate efficiently.

The most common system for producing these low pressure, low flow rate wells is through the use of sucker rod pumping systems. Sucker rod pumping systems include a downhole plunger and cylinder type pump connected to a surface unit commonly referred to as a pump jack via rods, or sucker rods. The present art sucker rod systems have several limits and problems. One problem is that while the stroke length of the pump and the strokes per minute may be controlled via selection of the size of the pump jack, these pumping jacks are expensive and each pump size is adapted for a specific range of flow rates and depth of the reservoir. Once the pump unit is placed it is cost prohibitive to change the pump jack. Another problem with these systems resides within the use of the sucker rods. Sucker rods are metal or fiberglass rods which are connected together to form one continuous string of rods often several thousand feet in length when used in hydrocarbon wells. These rod strings are connected usually via pin and box connections. The process of connecting the rod string when running into the hole or disconnecting the strings when pulling out of the hole is time consuming and costly. Additionally, the length and weight of these rods and the reciprocation of the rods produced by the pump jack results in failure, commonly by parting, of the sucker rod string. Another problem is that the sucker rod string is positioned within a tubular string such as tubing. When the system is operating the rod string commonly contacts the tubular string at several points which results in wear of both the rod string and the tubular string resulting in failure of the well. Some studies have shown that these rod pumping systems fail on the average of once every six months resulting in significant repair and maintenance costs, often making producing the well uneconomical. Failures rates in rod pumping systems greatly increase with the deviation of the well bore from vertical.

There have been attempts to develop a pumping system which utilizes the plunger/cylinder type downhole pump while eliminating the use of sucker rods and the related problems. These prior art rodless pump systems typically include a surface unit, which is connected to a subsurface pump by a fluid conduit such as the tubing string. The surface unit activates the subsurface pump by applying pressure to the fluid in the tubing string to compress a spring means in the subsurface pump and displace a slidable piston to draw fluid from the well into a pump chamber. When the surface unit releases the fluid pressure, a spring mechanism in the subsurface pump will displace the piston and lift the fluid in the pump chamber into the tubing string and to the surface. Such systems are disclosed in U.S. Pat. Nos. 2,058,455; 2,123,139; 2,126,880; and 2,508,609. Although, these prior art systems eliminate the rod string they utilize a compression spring for lifting the produced fluid into the tubing string. These springs severely limit the stroke length and thus flow rate of the pump and also tend to fail due to wear and or the accumulation of "trash" carried into the pump.

Other prior art rodless pumps such as disclosed in U.S. Pat. Nos. 4,297,088 replaces the physical spring with a gas chamber. When pressure is applied to the tubing string, a piston will compress the gas within the chamber and, when the pressure is relieved, the gas will expand to lift fluid into the tubing string. These systems allow for a very long stroke length and thus much higher efficiency, but introduces additional problems. A major problem with these prior art pumps is that unlike sucker rod pumps the rodless pumps do not have a precisely defined stroke length. In these rodless pumps, the stroke length is affected by the length of time the surface unit applies pressure to the fluid in the tubing string on each cycle. It is also affected by the compressibility of the fluid in the tubing string and the amount of ballooning of the tubing that occurs. The stroke length is also influenced by the pressure in the gas chamber, since the pressure in the gas chamber must be sufficient to support the hydrostatic pressure of the entire column of fluid back to the surface at the end of the downstroke, the plunger has enough force being applied to it at the end of the downstroke to cause it to strike the limit stop in the barrel with a severe impact. Also, since the surface unit must be capable of compressing this gas to a much higher pressure on the upstroke and due to the fact that the surface unit will not stop pressuring the tubing at the precise moment to prevent contact, the plunger will impact the limit stop on this end of the stroke. Thus, unlike sucker rod pumps, these pumps are difficult to design in a manner such that the maximum stroke may be utilized without the plunger contacting the barrel at the end of the upstroke and downstroke. This contact severely limits the life of the pumps.

It is thus a desire to have a rodless pump system which overcomes the limitations and problems of the prior art pumps. Wherein the rodless pump is connected to a pressure source via a conduit. In a common oilfield application the pump would be connected to the bottom of a tubing string within the reservoir fluid to be produced. A pressure source such as a hydraulic pump would be connected at the surface to the tubing string so as to selectively apply pressure via fluid in the conduit to the pump, raising the plunger assembly in the pump drawing reservoir fluid into the pump. When pressure via the surface pressure source is released, a gas source in the pump forces the plunger assembly downward in the pump pushing the reservoir fluid in the pump into the tubing and to the surface.

Preferably, the pump includes dampening mechanisms at both the top and bottom of the plunger's stroke so as to reduce metal to metal impact within the pump at the end of the top and bottom of the stroke of the plunger assembly. The dampening mechanism may include but is not limited to elastomer barriers, springs, and dampeners such as discussed further below. Several different configurations may be used singularly or in combination to reduce the metal to metal impact and increase the life of the pump.

The pump assembly may also include a charge valve in fluid connection with the pressure chamber so as to charge the chamber with gas, if the original gas contained within the pump dissipates. The gas chamber may be recharged through the charge valve via a pressurized source which may be run into the hole such as via a wireline.

BRIEF DESCRIPTION OF THE DRAWINGS

For a further understanding of the nature and objects of the present invention, reference should be had to the following detailed description, taken in conjunction with the accompanying drawings, in which like elements are given the same or analogous reference numbers and wherein.

DESCRIPTION

Figure 1:
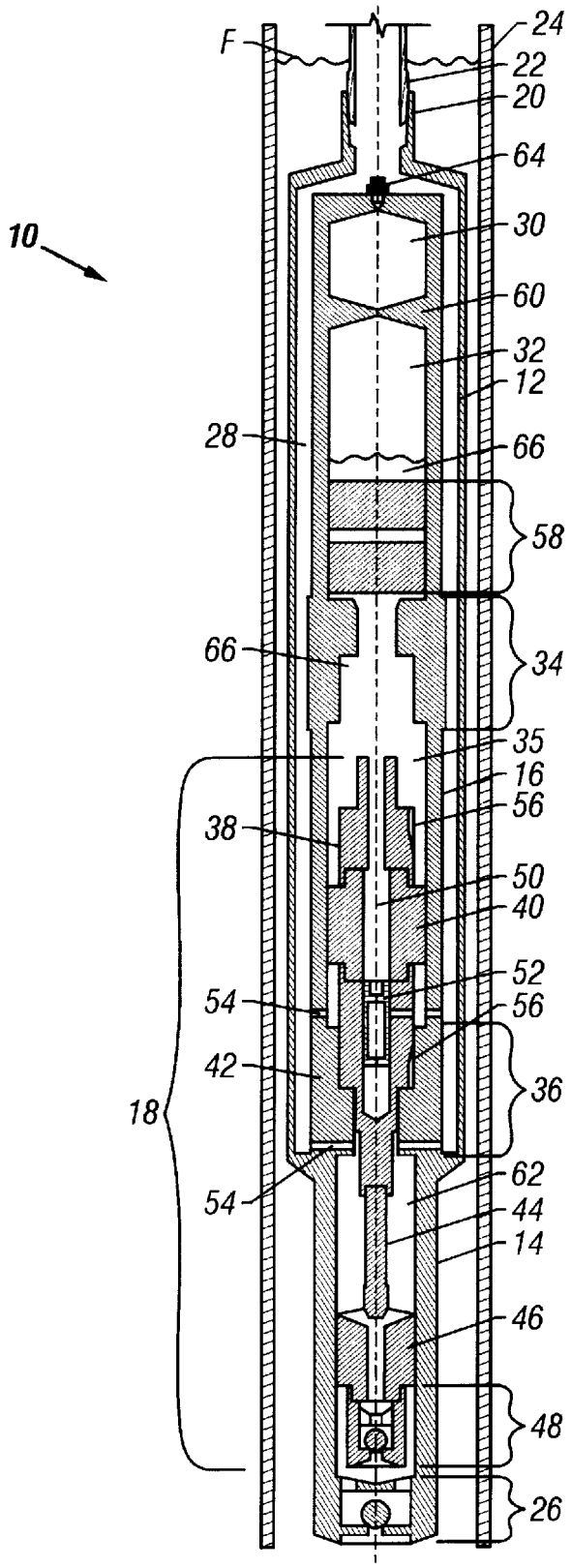
FIG. 1 is a cross-section view of the downhole pump of the rodless pump system of the present invention with the plunger assembly at the lowest most position of the pump stroke.

FIG. 1 is a cross-section view of the rodless pump of the present invention generally designated by the numeral 10. Rodless pump 10 includes a housing 12 having a lower barrel 14 extending therefrom, an upper barrel 16, and a plunger assembly 18 movably disposed therein.

As shown in FIG. 1, housing 12 has a top end 20 adapted for connecting to the tubing string 22 which is connected to a surface pumping unit (not shown) such as a hydraulic pump having a timed cycle for controlling the upstroke and downstroke of plunger assembly 18. Pump 10 is positioned at the bottom end of tubing 22 within the well casing 24 below the reservoir fluid level F.

Housing 12 is an elongated member extending to lower barrel 14. At the lower end of lower barrel 14 is a standing valve 26 to allow reservoir fluid to flow into housing 12 and prevent fluid from within housing 12 flowing out and back into casing 24. Positioned within housing 12 is upper barrel 16. Formed between housing 12, upper barrel 16, and the top of lower barrel 14 is a annulus 28 which is in fluid connection with tubing 22 for containing and producing reservoir fluid to the surface. At least one port 54 is formed through upper barrel 16 to allow fluid from annulus 28 into the interior of barrel 16 and vice versa.

Upper barrel 16 forms an interior gas chamber 30, free piston chamber 32, an upper dampening chamber 34, a barrier fluid chamber 35, and a lower dampening chamber 36. The interior chambers of upper barrel 16 and lower barrel 14 form a substantially continuous interior chamber when plunger assembly 18 is removed from pump 10.

Plunger assembly 18 includes an upper dampener 38, an upper plunger 40, a lower dampener 42, a rod 44, a lower plunger 46, and a traveling valve 48. Plunger assembly 18 may be of unitary construction or of various connected assemblies. Preferably, upper plunger 40 has a larger diameter than lower plunger 46. As shown, plunger assembly 18 may form an internal conduit 50 extending partially therethrough and has a relief valve 52 connected therein to dump excess fluid from barrier fluid chamber 35, into annulus 28 and into tubing string 22 when excess pressure is encountered within chamber 35.

Plunger assembly 18 is movable positioned within upper barrel 16 and lower barrel 14. Upper dampener 38, upper plunger 40, and lower dampener 42 being positioned within upper barrel 16 and lower plunger 46 and traveling valve 48 being positioned within lower barrel 14. The upper and lower section of plunger assembly 18 being interconnected by rod 44. Formed between upper plunger 40 and lower plunger 46 is a cavity 62.

Both upper dampener 38 and lower dampener 42 may have at least one slot formed along a portion of the length thereof to reduce contact between plunger assembly 18 and barrels 14, 16 both on the top of the upstroke and the bottom of the downstroke. The slot may extend only along a portion of dampener 38 and/or 42. Operation of slots 56 for dampening impact are discussed in detail below.

As shown in FIG. 1, gas chamber 30 and a portion of free piston chamber 32 are filled with a gas such as nitrogen. At least one free floating piston 58 is positioned within piston chamber 32 so as to be movable between limit stop 60 and the upper portion of barrel 16 forming upper dampening chamber 34. Floating piston 58 is designed to fit within chamber 32 to substantially prevent the flow of fluid from one side of piston 58 to the other. Piston or pistons 58 may include a seal, such as an 0-ring or other type ring or cup so as to substantially prevent the flow of fluid from one side of piston to 58 to the other while allowing the piston to move withing chamber 32. Additionally, limit stop 60 may allow fluid to pass between chambers 30 and 32. A charging valve may be in fluid connection with gas chamber 30 so as to facilitating charging chamber 30 with gas if needed.

A barrier fluid 66, such as a refined hydrocarbon to provide a barrier and cushion between the gas and produced fluid, is contained within barrier fluid chamber 35 and commonly above floating piston 58. On the upstroke a portion of the barrier fluid 66 passes through an orifice in limit stop 60 further dampening the impact of plunger assembly 18 with barrel 16. Upper plunger 40 forms a barrier between tubing fluid and the barrier fluid 66 which is used to contain the gas charge. Because the seal between upper plunger 40 and upper barrel 16 in which it strokes may be merely a very close fit, some transfer of fluid may occur. The pressure within fluid barrier chamber 35 is normally lower than the tubing pressure thus fluid is mostly transferred from the tubing to chamber 35, which may result in piston 58 riding higher in piston chamber 32 and thus decreasing the upstroke. To rectify this pressure relief valve 52 may be placed at the bottom of barrier chamber 35 in upper plunger 40 or thereabout. Relief valve 52 is set to dump fluid back to tubing 22 as pressure in gas chamber 30 increases over a set amount.

Operation of the pump system of the present invention is described with reference to FIGS. 1 through 7. Downhole rodless pump 10 is connected to the lower end of tubing 22 and run into casing 24 preferably below reservoir fluid level F. The top of tubing string 22 is connected to a surface unit to apply and release pressure in the tubing string.

FIG. 1 shows plunger assembly 18 in its lowermost position with the well fluid static and only hydrostatic pressure is present at the position of pump 10. Free pistons 58 are at their lowest most position. Gas pressure within pump 10 is at its lowest value. Standing valve 26 and traveling valve 48 are both closed. Lower dampener 42 is positioned within lower dampener chamber 36 in a substantially tight fit.

Figure 2:
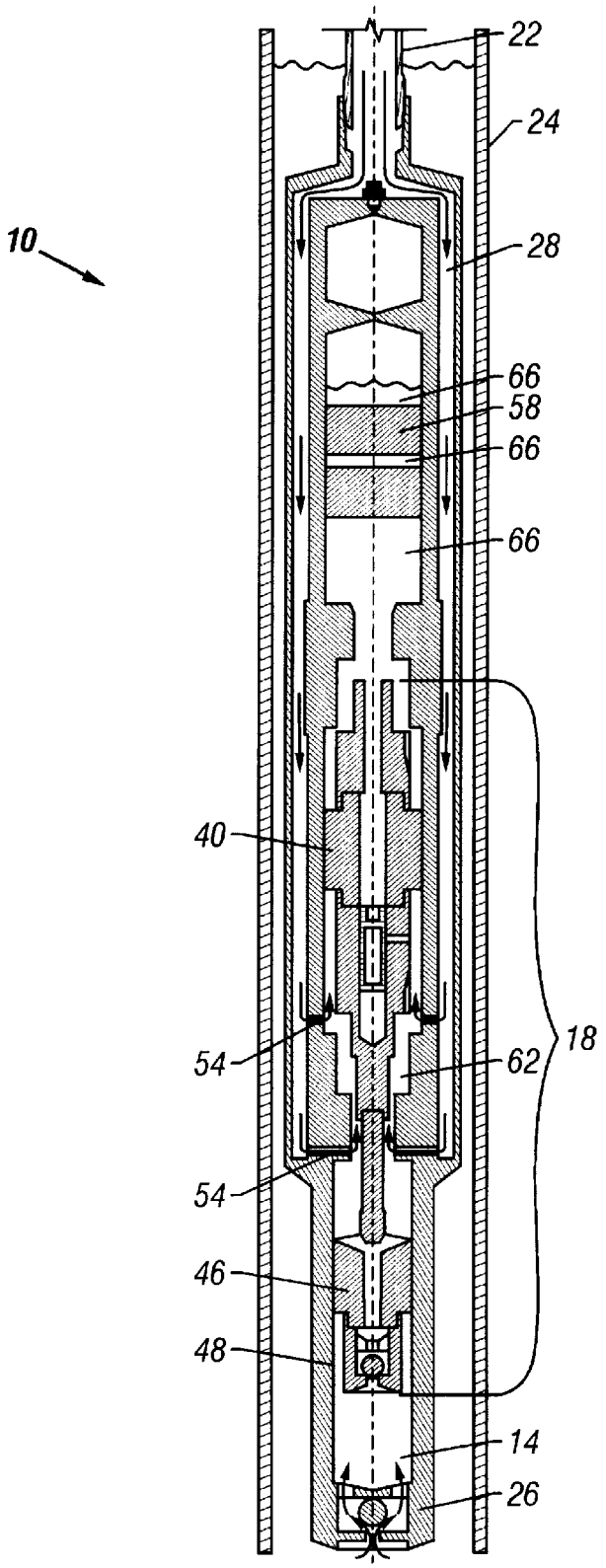
FIG. 2 is a cross-section view of the downhole pump of the rodless pump system of the present invention with the plunger assembly moving upward in response to the application of pressure from a surface pumping unit to the fluid in the tubing string.

FIG. 2 shows plunger assembly 18 of pump 10 beginning to move upward. As the surface unit is activated fluid is pumped down tubing 22 (as shown by the arrows) into annulus 28 through ports 54 into cavity 62 between upper and lower plungers 40 and 46 moving plunger assembly 18 upward due to the larger diameter of plunger 40 as opposed to the diameter of plunger 46. Fluid pressure increases to equal and then exceeds the gas pressure causing pistons 58 to move upward compressing the gas. The gas pressure and fluid pressure remain substantially equal through the rest of the stroke. Traveling valve 48 remains closed and standing valve 26 opens to allow fluid from casing 24 to enter and fill lower barrel 14.

Figure 3:
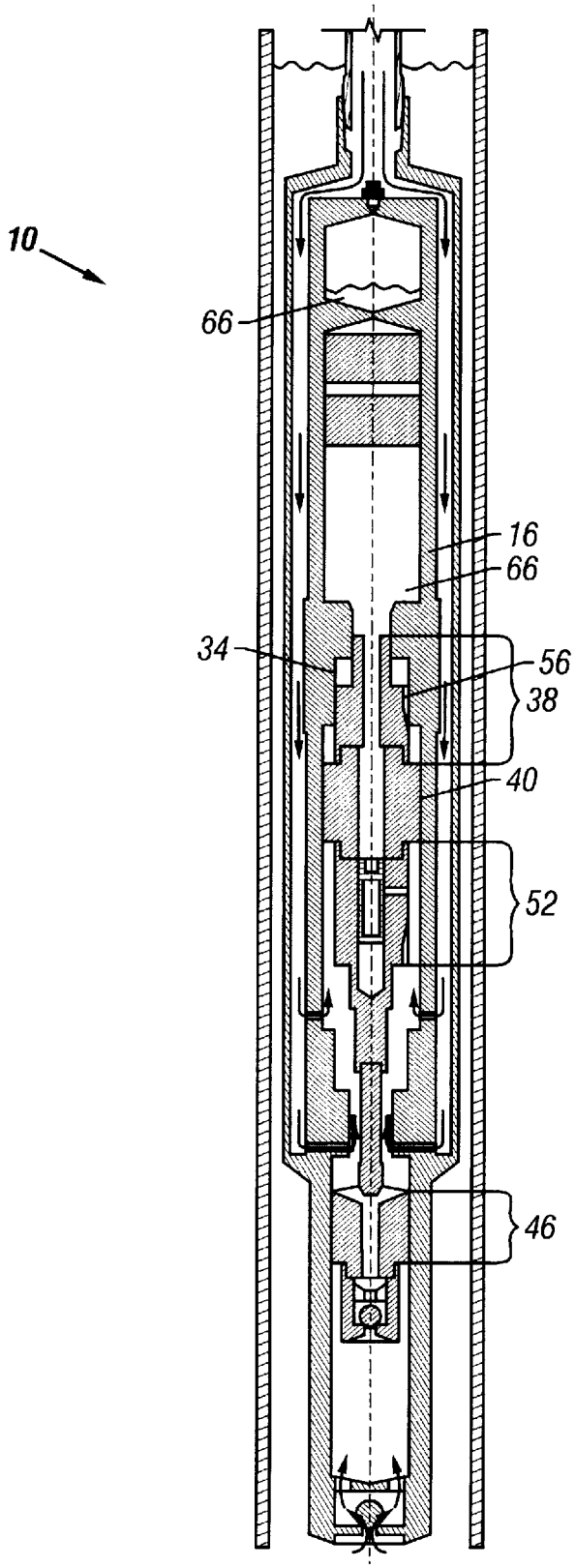
FIG. 3 is a cross-section view of the downhole pump of the rodless pump system of the present invention with the plunger assembly nearing the top of the upstroke.

FIG. 3 shows pump 10 with plunger assembly 18 nearing the top of the stroke. Upper dampener 38 is entering dampener chamber 34. Fluid is being metered out of chamber 34 through slot 56 in the dampener at a controlled rate to decelerate plunger assembly 18. An end of slot 56 is just entering camber 34, trapping the remaining fluid, and stopping plunger assembly 18 before dampener 38 impacts upper barrel 16 forming chamber 34.

Figure 4:
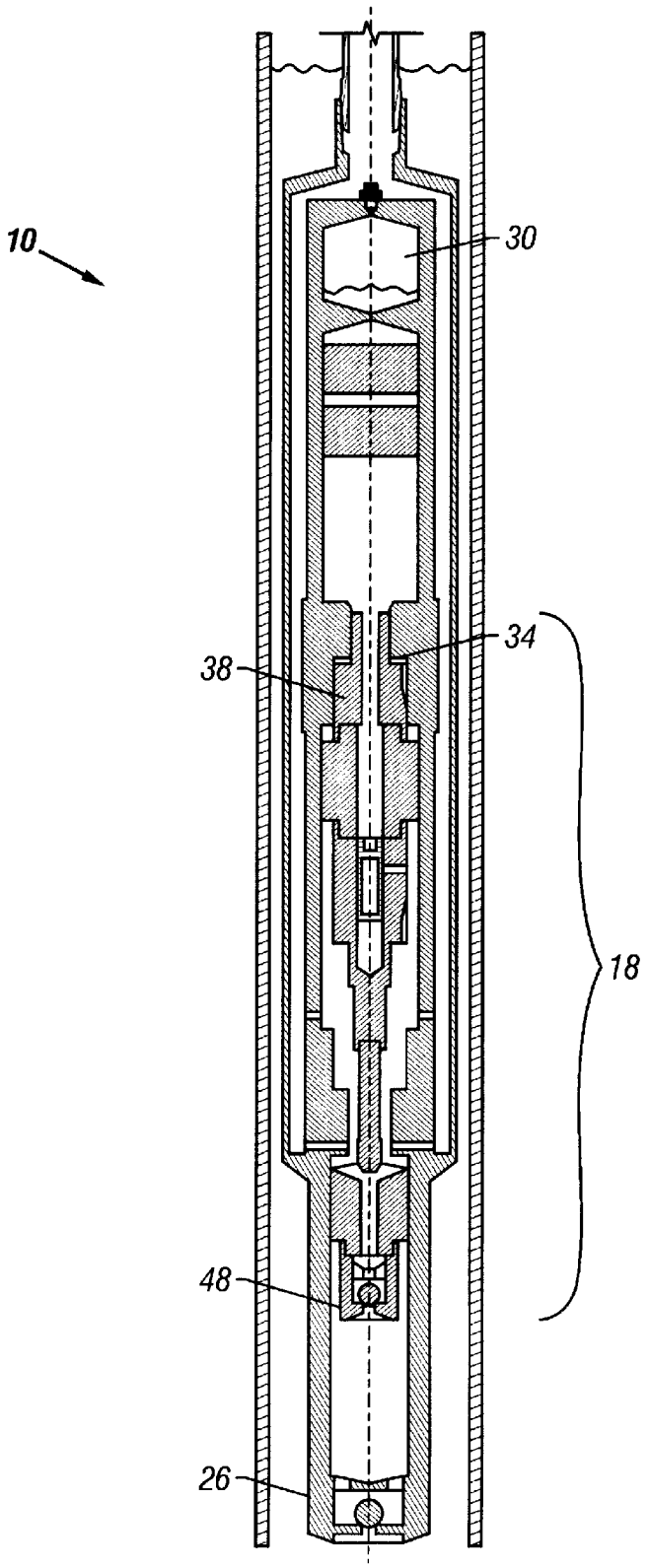
FIG. 4 is a cross-section view of the downhole pump of the rodless pump system of the present invention with the plunger assembly at the top of the upstroke.

FIG. 4 shows plunger assembly 18 at the upper most part of the upstroke. Some fluid has leaked out of dampening chamber 34 as the surface unit bleeds tubing pressure back down to hydrostatic pressure at pump 10; therefore, dampener 38 is shown closer to the upper stop of chamber 34. Gas pressure in chamber is at its maximum and fluid motion has substantially ceased. Both traveling valve 48 and standing valve 26 are closed.

Figure 5:
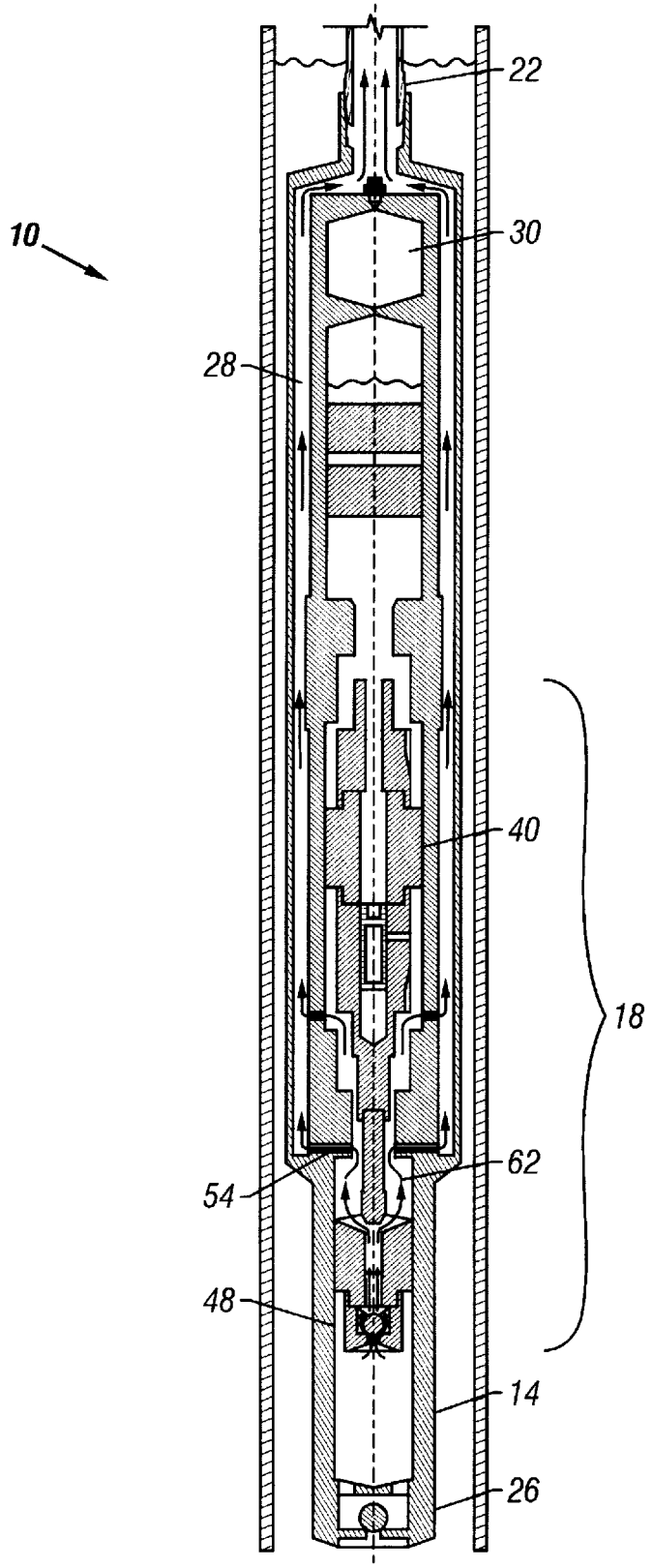
FIG. 5 is a cross-section view of the downhole pump of the rodless pump system of the present invention with the plunger assembly moving in a downward direction in response to the decrease in pressure from the surface pumping unit and the application of pressure from the gas chamber to the fluid above the upper plunger.

FIG. 5 shows plunger assembly 18 moving in a downward direction in response to pressure from gas chamber 30 to the fluid above upper plunger 40. Standing valve 26 is closed and traveling valve 48 opens. Reservoir fluid in lower barrel 14 passes through traveling valve 48 into cavity 62, through ports 54 into annulus 28 and up tubing string 22 to be produced at the surface.

Figure 6:
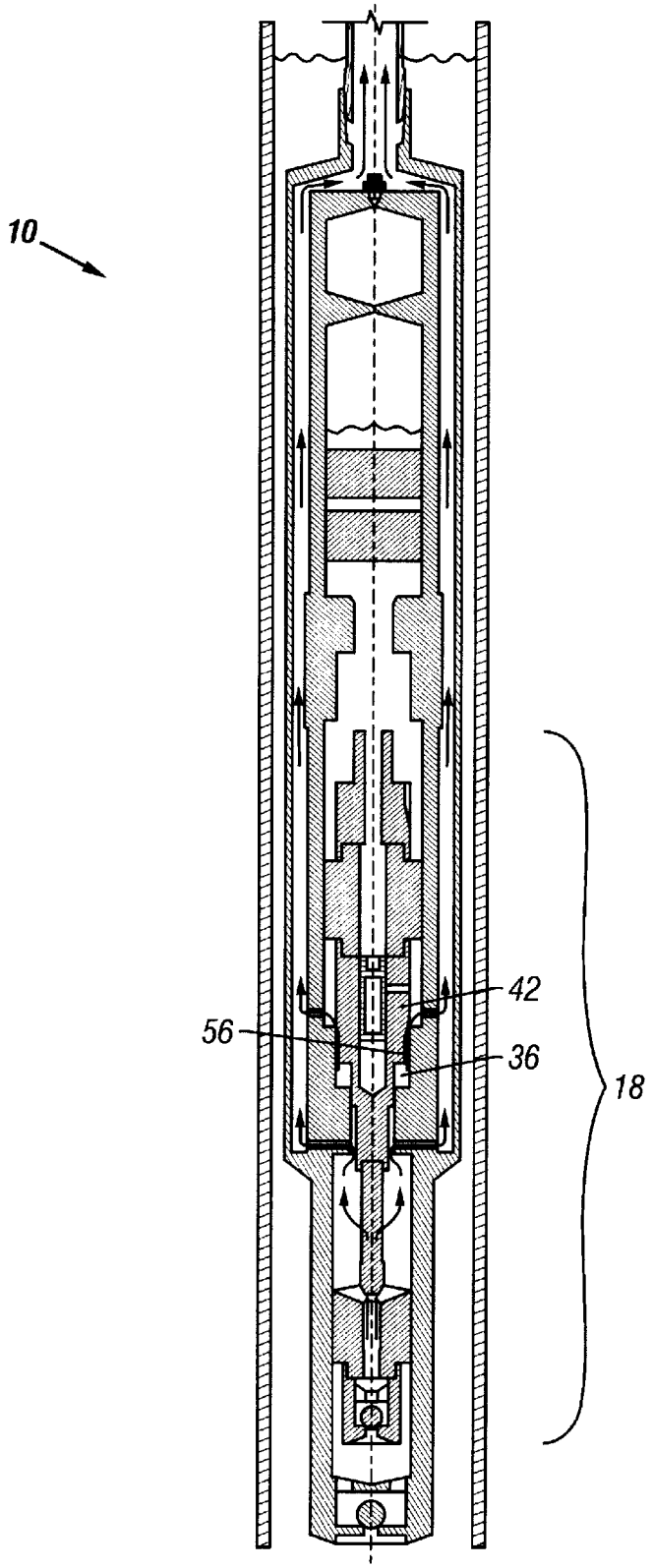
FIG. 6 is a cross-section view of the downhole pump of the rodless pump system of the present invention with the plunger assembly nearing the bottom of the downstroke.

FIG. 6 shows plunger assembly 18 nearing the bottom of the downstroke. Lower dampener 42 has entered lower dampener chamber 36 and fluid is being metered out of dampener chamber 36 via slot 56. The end of slot 56 has yet to enter chamber 36 thereby trapping the remaining fluid and stopping plunger assembly 18 before metal to metal impact occurs.

Figure 7:
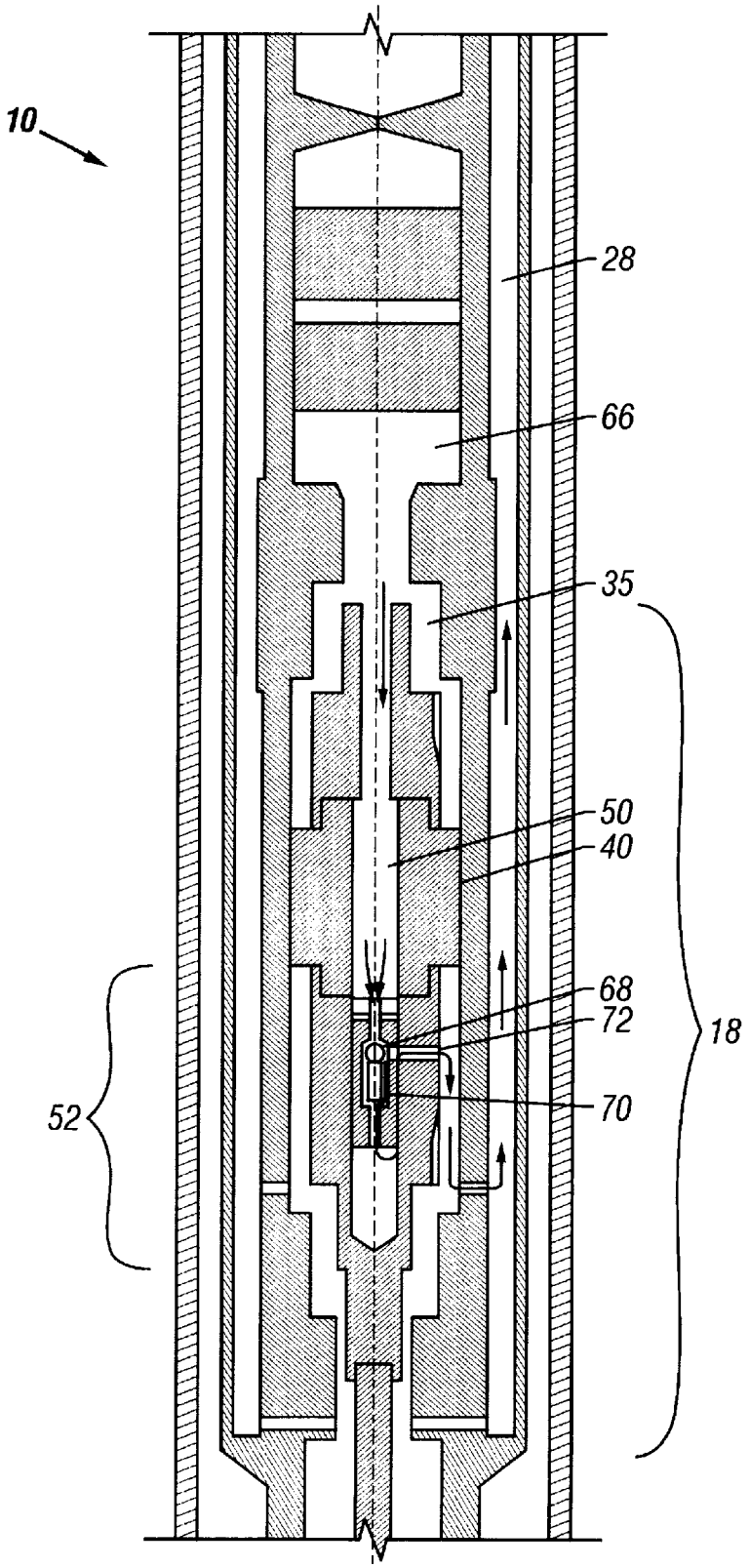
FIG. 7 is an enlarged, cross-section view of a pressure relief valve for use in the downhole pump of the present invention.

The process as shown in FIGS. 1 through 6 is repeated until the well is pumped down. FIG. 7 is an enlarged cross-section view of plunger assembly 18 showing the utilization of relief valve 52. When fluid volume builds up to a point where the pressure in the barrier fluid chamber 35 exceeds the set value of relief valve 52, excess fluid is dumped to annulus 28 and into tubing string 22. As shown, relieve valve 52, is connected so as to be a part of plunger assembly 18, and in fluid communication with barrier fluid chamber 35 via conduit 50. Relief valve 52 includes a ball 68 positioned atop of a spring 70 and a port 72 formed through relief valve 52 portion of plunger assembly 18 in communication between conduit 50 and annulus 28. In this embodiment, the set value for allowing fluid to be expelled into annulus 28 and thus tubing 22 is the spring constant of spring 70.

Those who are skilled in the art will readily perceive how to modify the present invention still further. For example, many connections illustrated are threaded, however, it should be recognized that other methods of connection may be utilized, such as by welding. Additionally, there are many connectors and spacers and additional equipment which may be used within and in connection with the present invention. In addition, the subject matter of the present invention would not be considered limited to a particular material of construction. Therefore, many materials of construction are contemplated by the present invention including but not limited to metals, fiberglass, plastics as well as combinations and variations thereof As many possible embodiments may be made of the present invention without departing from the scope thereof, it is to be understood that all matter herein set forth or shown in the accompanying drawings is to be interpreted as illustrative and not in a limiting sense.

What is claimed is:

1. A rodless pump assembly for pumping fluid from a fluid reservoir connected via a conduit to a operational pressure source, the rodless pump being responsive to the application of pressure on fluid within the conduit by the operational pressure source, said pump assembly comprising:

a housing connected at the lower end of a conduit and positioned within a fluid to be transported through said conduit;

a plunger assembly movably disposed within said housing, said assembly movable in a first direction responsive to pressure applied to fluid in said conduit for drawing fluid into said housing;

a pressure chamber formed within said housing above said plunger assembly containing a substantially compressible fluid therein for moving said plunger assembly in a second direction when pressure is released from said fluid in said conduit wherein fluid from said reservoir drawn into said housing is produced into said housing; and a dampening mechanism connected to said plunger assembly wherein impact between said plunger moving in said first direction and a portion of said housing is reduced.

2. The rodless pump of claim 1, further including:

a second dampening mechanism connected to said plunger assembly wherein impact between said plunger moving in said second direction and a portion of said housing is reduced.

3. The rodless pump of claim 2, wherein:

said second dampening mechanism includes a lower dampener connected to said plunger assembly; and a lower dampener chamber formed by said housing shaped so as to fit said lower dampener substantially therein.

4. The rodless pump of claim 3, further including:

a slot formed along at least a portion of said lower dampener.

5. The rodless pump of claim 4, further including:

a barrier fluid contained within said housing and substantially between said pressure chamber and said plunger assembly.

6. The rodless pump of claim 5, further including:

at least one barrier movably positioned between said pressure chamber and said plunger.

7. The rodless pump of claim 3, further including:

a barrier fluid contained within said housing and substantially between said pressure chamber and said plunger assembly.

8. The rodless pump of claim 7, further including:

at least one barrier movably positioned between said pressure chamber and said plunger.

9. The rodless pump of claim 2, further including:

a barrier fluid contained within said housing and substantially between said pressure chamber and said plunger assembly.

10. The rodless pump of claim 1, wherein:

said dampening mechanism includes an upper dampener connected to said plunger assembly; and an upper dampener chamber formed by said housing shaped so as to fit said upper dampener substantially therein.

11. The rodless pump of claim 10, further including:

a slot formed along at least a portion of said upper dampener.

12. The rodless pump of claim 11, further including:

a second dampening mechanism having a lower dampener connected to said plunger assembly; and a lower dampener chamber formed by said housing shaped so as to fit said lower dampener substantially therein.

13. The rodless pump of claim 12, further including:

a slot formed along at least a portion of said lower dampener.

14. The rodless pump of claim 13, further including:

a barrier fluid contained within said housing and substantially between said pressure chamber and said plunger assembly.

15. The rodless pump of claim 14, further including:

at least one barrier movably positioned between said pressure chamber and said plunger.

16. The rodless pump of claim 12, further including:

a barrier fluid contained within said housing and substantially between said pressure chamber and said plunger assembly.

17. The rodless pump of claim 16, further including:

at least one barrier movably positioned between said pressure chamber and said plunger.

18. The rodless pump of claim 11, further including:

a barrier fluid contained within said housing and substantially between said pressure chamber and said plunger assembly.

19. The rodless pump of claim 18, further including:

at least one barrier movably positioned between said pressure chamber and said plunger.

20. The rodless pump of claim 10, further including:

a second dampening mechanism having a lower dampener connected to said plunger assembly; and a lower dampener chamber formed by said housing shaped so as to fit said lower dampener substantially therein.

21. The rodless pump of claim 20, further including:

a slot formed along at least a portion of said lower dampener.

22. The rodless pump of claim 21, further including:

a barrier fluid contained within said housing and substantially between said pressure chamber and said plunger assembly.

23. The rodless pump of claim 22, further including:

at least one barrier movably positioned between said pressure chamber and said plunger.

24. The rodless pump of claim 20, further including:

a barrier fluid contained within said housing and substantially between said pressure chamber and said plunger assembly.

25. The rodless pump of claim 24, further including:

at least one barrier movably positioned between said pressure chamber and said plunger.

26. The rodless pump of claim 10, further including:

a barrier fluid contained within said housing and substantially between said pressure chamber and said plunger assembly.

27. The rodless pump of claim 26, further including:

at least one barrier movably positioned between said pressure chamber and said plunger.

28. The rodless pump of claim 1, further including:

a barrier fluid contained within said housing and substantially between said pressure chamber and said plunger assembly.

29. A rodless pump assembly for pumping fluid from a fluid reservoir connected via a conduit to a operational pressure source, the rodless pump being responsive to the application of pressure on fluid within the conduit by the operational pressure source, said pump assembly comprising:

a housing connected at the lower end of a conduit and positioned within a fluid to be transported through said conduit, said housing including a lower barrel section extending from said housing and an upper barrel section located within said housing;

a plunger assembly movably disposed within said upper and lower barrel of said housing, said assembly movable in a first direction responsive to pressure applied to fluid in said conduit for drawing fluid into said housing;

a pressure chamber formed within said housing above said plunger assembly containing a substantially compressible fluid therein for moving said plunger assembly in a second direction when pressure is released from said fluid in said conduit wherein fluid from said reservoir drawn into said housing is produced into said housing;

an upper dampening mechanism connected to said plunger assembly wherein impact between said plunger moving in said first direction and a portion of said housing upper barrel is reduced; and a lower dampening mechanism connected to said plunger assembly wherein impact between said plunger moving in said second direction and a portion of said housing is reduced.

30. The rodless pump of claim 29, wherein:

said upper dampening mechanism includes an upper dampener connected to said plunger assembly; and an upper dampener chamber formed by said upper barrel of said housing shaped so as to fit said upper dampener substantially therein.

31. The rodless pump of claim 30, further including:

a slot formed along at least a portion of said upper dampener.

32. The rodless pump of claim 31, wherein:

said lower dampening mechanism includes a lower dampener connected to said plunger assembly; and a lower dampener chamber formed by said housing shaped so as to fit said lower dampener substantially therein.

33. The rodless pump of claim 32, further including:

a slot formed along at least a portion of said lower dampener.

34. The rodless pump of claim 33, further including:

a barrier fluid contained within said housing and substantially between said pressure chamber and said plunger assembly.

35. The rodless pump of claim 34, further including:

at least one barrier movably positioned between said pressure chamber and said plunger.

36. The rodless pump of claim 34, further including:

a pathway formed at least partially through said plunger; and a pressure relief mechanism in fluid connection with said pathway for allowing a portion of fluid above said plunger to be expelled to said conduit.

37. The rodless pump of claim 32, further including:

a barrier fluid contained within said housing and substantially between said pressure chamber and said plunger assembly.

38. The rodless pump of claim 37, further including:

at least one barrier movably positioned between said pressure chamber and said plunger.

39. The rodless pump of claim 31, further including:

a barrier fluid contained within said housing and substantially between said pressure chamber and said plunger assembly.

40. The rodless pump of claim 39, further including:

at least one barrier movably positioned between said pressure chamber and said plunger.

41. The rodless pump of claim 39, further including:

a pathway formed at least partially through said plunger; and a pressure relief mechanism in fluid connection with said pathway for allowing a portion of fluid above said plunger to be expelled to said conduit.

42. The rodless pump of claim 30, wherein:

said lower dampening mechanism includes a lower dampener connected to said plunger assembly; and a lower dampener chamber formed by said housing shaped so as to fit said lower dampener substantially therein.

43. The rodless pump of claim 42, further including:

a slot formed along at least a portion of said lower dampener.

44. The rodless pump of claim 43, further including:

a barrier fluid contained within said housing and substantially between said pressure chamber and said plunger assembly.

45. The rodless pump of claim 44, further including:

at least one barrier movably positioned between said pressure chamber and said plunger.

46. The rodless pump of claim 42, further including:

a barrier fluid contained within said housing and substantially between said pressure chamber and said plunger assembly.

47. The rodless pump of claim 46, further including:

at least one barrier movably positioned between said pressure chamber and said plunger.

48. The rodless pump of claim 46, further including:

a pathway formed at least partially through said plunger; and a pressure relief mechanism in fluid connection with said pathway for allowing a portion of fluid above said plunger to be expelled to said conduit.

49. The rodless pump of claim 30, further including:

a barrier fluid contained within said housing and substantially between said pressure chamber and said plunger assembly.

50. The rodless pump of claim 49, further including:

at least one barrier movably positioned between said pressure chamber and said plunger.

51. The rodless pump of claim 29, wherein:

said lower dampening mechanism includes a lower dampener connected to said plunger assembly; and a lower dampener chamber formed by said housing shaped so as to fit said lower dampener substantially therein.

52. The rodless pump of claim 51, further including:

a slot formed along at least a portion of said lower dampener.

53. The rodless pump of claim 52, further including:

a barrier fluid contained within said housing and substantially between said pressure chamber and said plunger assembly.

54. The rodless pump of claim 53, further including:

at least one barrier movably positioned between said pressure chamber and said plunger.

55. The rodless pump of claim 53, further including:

a pathway formed at least partially through said plunger; and a pressure relief mechanism in fluid connection with said pathway for allowing a portion of fluid above said plunger to be expelled to said conduit.

56. The rodless pump of claim 51, further including:

a barrier fluid contained within said housing and substantially between said pressure chamber and said plunger assembly.

57. The rodless pump of claim 56, further including:

at least one barrier movably positioned between said pressure chamber and said plunger.

58. The rodless pump of claim 29, further including:

a barrier fluid contained within said housing and substantially between said pressure chamber and said plunger assembly.

59. The rodless pump of claim 58, further including:

at least one barrier movably positioned between said pressure chamber and said plunger.

60. A rodless pump assembly for pumping fluid from a fluid reservoir connected via a conduit to a operational pressure source, the rodless pump being responsive to the application of pressure on fluid within the conduit by the operational pressure source, said pump assembly comprising:

a housing connected at the lower end of a conduit and positioned within a fluid to be transported through said conduit, said housing including a lower barrel section extending from said housing and an upper barrel section located within said housing;

a plunger assembly movably disposed within said upper and lower barrel of said housing, said assembly movable in a first direction responsive to pressure applied to fluid in said conduit for drawing fluid into said housing;

a pressure chamber formed within said housing above said plunger assembly containing a substantially compressible fluid therein for moving said plunger assembly in a second direction when pressure is released from said fluid in said conduit wherein fluid from said reservoir drawn into said housing is produced into said housing;

a barrier fluid substantially contained within a chamber formed within said upper barrel of said housing between said pressure chamber and said plunger assembly;

an upper dampening mechanism connected to said plunger assembly wherein impact between said plunger moving in said first direction and a portion of said housing upper barrel is reduced; and a lower dampening mechanism connected to said plunger assembly wherein impact between said plunger moving in said second direction and a portion of said housing is reduced.

61. The rodless pump of claim 60, wherein:

said upper dampening mechanism includes an upper dampener connected to said plunger assembly; and an upper dampener chamber formed by said upper barrel of said housing shaped so as to fit said upper dampener substantially therein.

62. The rodless pump of claim 61, further including:

a slot formed along at least a portion of said upper dampener.

63. The rodless pump of claim 60, wherein:

said lower dampening mechanism includes a lower dampener connected to said plunger assembly; and a lower dampener chamber formed by said housing shaped so as to fit said lower dampener substantially therein.

64. The rodless pump of claim 63, further including:

a slot formed along at least a portion of said lower dampener.

65. The rodless pump of claim 60, wherein:

said upper dampening mechanism includes an upper dampener connected to said plunger assembly;

an upper dampener chamber formed by said upper barrel of said housing shaped so as to fit said upper dampener substantially therein;

said lower dampening mechanism includes a lower dampener connected to said plunger assembly; and a lower dampener chamber formed by said housing shaped so as to fit said lower dampener substantially therein.

66. The rodless pump of claim 60, further including:

at least one barrier movably positioned between said pressure chamber and said plunger.

67. The rodless pump of claim 65, further including:

at least one barrier movably positioned between said pressure chamber and said plunger.

68. The rodless pump of claim 65, further including:

a pathway formed at least partially through said plunger; and a pressure relief mechanism in fluid connection with said pathway for allowing a portion of fluid above said plunger to be expelled to said conduit.

69. The rodless pump of claim 60, further including:

a pathway formed at least partially through said plunger; and a pressure relief mechanism in fluid connection with said pathway for allowing a portion of fluid above said plunger to be expelled to said conduit.

70. A rodless pump assembly for pumping fluid from a fluid reservoir connected via a conduit to a operational pressure source, the rodless pump being responsive to the application of pressure on fluid within the conduit by the operational pressure source, said pump assembly comprising:

a housing connected at the lower end of a conduit and positioned within a fluid to be transported through said conduit, said housing including a lower barrel section extending from said housing and an upper barrel section located within said housing;

a plunger assembly movably disposed within said upper and lower barrel of said housing, said assembly movable in a first direction responsive to pressure applied to fluid in said conduit for drawing fluid into said housing;

a pressure chamber formed within said housing above said plunger assembly containing a substantially compressible fluid therein for moving said plunger assembly in a second direction when pressure is released from said fluid in said conduit wherein fluid from said reservoir drawn into said housing is produced into said housing;

at least one barrier movably positioned between said pressure chamber and said plunger;

a barrier fluid substantially contained within a chamber formed within said upper barrel of said housing between said pressure chamber and said plunger assembly;

an upper dampening mechanism having an upper dampener connected to said plunger assembly, and an upper dampener chamber formed by said upper barrel of said housing so as to fit said upper dampener substantially therein; and a lower dampening mechanism having a lower dampener connected to said plunger assembly, and a lower dampener chamber formed by said upper barrel of said housing so as to fit said lower dampener substantially therein.

71. The rodless pump of claim 70, further including:

a pathway formed at least partially through said plunger; and a pressure relief mechanism in fluid connection with said pathway for allowing a portion of fluid above said plunger to be expelled to said conduit.

72. The rodless pump of claim 71, further including:

a slot formed along at least a portion of said upper dampener.

73. The rodless pump of claim 71, further including:

a slot formed along at least a portion of said lower dampener.

74. The rodless pump of claim 71, further including:

a slot formed along at leasta portion of said upper dampener; and a slot formed along at least a portion of said lower dampener.

* * * * *